US005887235A

United States Patent [19]

Wayman et al.

[11] Patent Number: 5,887,235

[45] Date of Patent: Mar. 23, 1999

[54] VARIABLE GLOSS FUSER

[75] Inventors: William H. Wayman, Ontario; Rasin Moser, Fairport, both of N.Y.

[73] Assignee: Xerox Corporation, Stamford, Conn.

[21] Appl. No.: 169,836

[22] Filed: Dec. 16, 1993

[51] Int. Cl.[6] ..... G03G 15/20

[52] U.S. Cl. ..... 399/329; 328/341

[58] Field of Search ..... 355/282, 285, 355/289, 290, 295, 77; 219/216; 118/60; 399/67, 69, 320, 328, 329, 331, 334, 335, 338, 341, 342

[56] References Cited

U.S. PATENT DOCUMENTS

| | | | |
|---|---|---|---|
| 4,563,073 | 1/1986 | Reynolds | 355/284 |
| 4,565,439 | 1/1986 | Reynolds | 355/290 |
| 4,582,416 | 4/1986 | Karz et al. | 355/290 |
| 4,780,742 | 10/1988 | Takahashi et al. | 355/290 |
| 4,813,372 | 3/1989 | Kogure et al. | 118/60 |
| 4,973,824 | 11/1990 | Ohashi et al. | 219/216 |
| 5,084,738 | 1/1992 | Ishikawa | 355/285 |
| 5,099,288 | 3/1992 | Britto et al. | 355/290 |
| 5,153,656 | 10/1992 | Johnson et al. | 355/290 |
| 5,164,782 | 11/1992 | Nagayama et al. | 355/285 |
| 5,182,606 | 1/1993 | Yamamoto et al. | 355/289 |
| 5,235,393 | 8/1993 | Merle | 355/282 |

*Primary Examiner*—Sandra L. Brase

[57] ABSTRACT

Three fuser rollers cooperate with a pressure roller to form an extended fusing zone through which a substrate carrying toner images passes with the toner images contacting a fusing belt. Electrical power is applied to the three fuser rolls in such a manner that the portions of the belt in a fusing zone are heated to a predetermined operating temperature in accordance with a setpoint temperature. The free extent of the belt or in other words the portion of the belt outside of the fusing zone is adapted to be heated to various operating temperatures in order to produce prints with different gloss as desired.

10 Claims, 3 Drawing Sheets

VARIABLE GLOSS FUSER

BACKGROUND OF THE INVENTION

This invention relates to the art of forming powder images and, more particularly, to heat and pressure belt fuser apparatus wherein image gloss is varied by varying the temperature of images just prior to stripping.

In the art of xerography or other similar image reproducing arts, a latent electrostatic image is formed on a charge-retentive surface which may comprise a photoconductor which generally comprises a photoconductive insulating material adhered to a conductive backing. When the image is formed on a photoconductor, the photoconductor is first provided with a uniform charge after which it is exposed to a light image of an original document to be reproduced. The latent electrostatic images, thus formed, are rendered visible by applying any one of numerous pigmented resins specifically designed for this purpose.

It should be understood that for the purposes of the present invention the latent electrostatic image may be formed by means other than by the exposure of an electrostatically charged photosensitive member to a light image of an original document. For example, the latent electrostatic image may be generated from information electronically stored or generated, and this information in digital form may be converted to alphanumeric images by image generation electronics and optics. However, such image generation electronic and optic devices form no part of the present invention.

In the case of a reusable photoconductive surface, the pigmented resin, more commonly referred to as toner which forms the visible images is transferred to a substrate such as plain paper. After transfer the images are made to adhere to the substrate using a fuser apparatus. To date, the use of simultaneous heat and contact pressure for fusing toner images has been the most widely accepted commercially, the most common being ones that utilize a pair of pressure engaged rolls.

Conventional roll fusers operate within a narrow range of temperatures. Image gloss is limited by roll surface texture and toner resin glass transition temperature and molecular weight. Fuser latitude is limited on the low end (i.e. low process speed machines) by poor image fix and on the high end (i.e. high process machines) by hot offset. Large changes in fuser roll temperature are required to appreciably affect image gloss which changes.

While belt fusers are known in the prior art they do not provide for creating prints with exhibiting different gloss characteristics.

A number of belt fusers, some of which may be relevant to certain aspects of the present invention, are noted.

U.S. patent application Ser. No. 08/168,833 which is assigned to the same assignee as the instant invention relates to a belt fuser wherein three fuser rollers cooperate with a pressure roller to form an extended fusing zone through which a substrate carrying toner images passes with the toner images contacting fusing belt. Electrical power is applied to the three contact rolls in such a manner that only the portions of the belt in the fusing zone are heated. Thus, the energy is concentrated only in the part of the fusing belt where it is needed for fusing the toner images on the final substrate. Thus, the free extent of the belt or in other words the portion of the belt outside of the fusing zone remains unheated.

U.S. patent application Ser. No. 08/169,838 which is assigned to the same assignee as the instant invention relates to a power controller, which does not rely on the use of sensors such as thermistors to control the operating temperature of a belt fuser. It features various preset inputs to control: steady state watts/in, cold start boost watts/in, warmup and cooldown time constants.

The controller sets the desired power based on the on-off cycling of the system. There are no sensors used to measure fuser temperature. For a cold start, the steady state plus boost power is used, during warmup the boost level is exponentially decreased at a rate set by a warmup time constant. When at rest (with no applied power) the power setpoint is exponentially increased at a rate set by a cooldown time constant.

U.S. patent application Ser. No. 08/169,802 which is assigned to the same assignee as the instant invention relates to a belt fuser for fusing transparencies without having to resort to off-line methods and apparatus. The toner images which are formed on the transparency during the imaging process have time to cool prior to separation from a smooth-surfaced belt.

The peak fusing temperature is significantly higher than used with conventional fusers such as heat and pressure roll fusers. This higher temperature guarantees excellent toner melting and flow thereby producing transparencies with excellent projection efficiency.

U.S. patent application Ser. No. 08/168,835 which is assigned to the same assignee as the instant invention relates to a belt fuser wherein three fuser rollers cooperate with a pressure roller to form an extended fusing zone through which a substrate carrying toner images passes with the toner images contacting fusing belt. Electrical power is applied to the three contact rolls in such a manner that only the portions of the belt in the fusing zone are heated. Thus, the energy is concentrated only in the part of the fusing belt where it is needed for fusing the toner images on the final substrate. Thus, the free extent of the belt or in other words the portion of the belt outside of the fusing zone remains unheated.

To ensure good electrical contact in the presence of silicone oil contamination on the electrically resistive inner surface of the fusing belt, the contact rollers are textured by knurling, bead blasting or other suitable means.

U.S. patent application Ser. No. 08/168,891 which is assigned to the same assignee as the instant invention relates to belt fuser wherein three fuser rollers cooperate with a pressure roller to form an extended fusing zone through which a substrate carrying toner images passes with the toner images contacting fusing belt. Electrical power is applied to the three fuser rolls in such a manner that only the portions of the belt between the rollers are heated. Thus, the energy is concentrated only in the part of the fusing belt where it is needed for fusing the toner images on the final substrate. Thus, the free extent of the belt or in other words the portion of the belt outside of the fusing zone remains unheated. Toner images are directly formed on or transferred to the unheated portion of the fusing belt. The images carried by the belt are then moved through the fusing zone nip where the images are simultaneously fused and transferred to a final substrate.

U.S. Pat. No. 4,565,439 granted to Scott D. Reynolds on Jan. 21, 1986 relates to a belt fuser for fusing toner images. The fusing apparatus is characterized by the separation of the heat and pressure functions such that the heat and pressure are effected at different locations on a thin flexible belt forming the toner contacting surface. A pressure roll cooperates with a non-rotating mandrel to form a nip through which the belt and copy substrate pass simultaneously. The belt is heated such that by the time it passes through the nip its temperature together with the applied pressure is sufficient for fusing the toner images passing therethrough. The non-rotating mandrel is adapted to having its axis skewed relative to the axis of the pressure roll. A pair of edge sensors are provided for activating a mandrel skewing mechanism. Skewing of the mandrel by such mechanism effects proper belt tracking. U.S. Pat. No. 4,563,073 granted to Scott D. Reynolds on Jan. 7, 1986 relates to a low mass heat and pressure fuser and release agent management system therefor.

U.S. Pat. No. 5,084,738 granted to Noriyoshi Ishikawa on Jan. 28, 1992 discloses a fusing apparatus having an electrically conductive film which moves in contact with a recording material to which a toner image has been transferred, a pressing roller for causing the film to be brought into contact with the recording material and a plurality of electrodes disposed along a nip between the film and the pressing roller at a position opposing this pressing roller. The electrically conductive film heats up substantially only in the nip as the result of an electrical conductance to this electrode. The toner image on the recording material is heated and fixed by the heat generated in the electrically conductive film positioned in the nip. In a modified embodiment of the foregoing fusing device, a fusing film is fabricated using a thin-film conductive layer made by aluminum deposition or the like. The conductive layer is disposed on the side of a base film comprising carbon black added to a polycarbonate that will contact the transfer material on which a picture image is carried. Power is supplied between a first electrode and a second electrode. Joule heat is produced in the thickness direction of the fusing film.

U.S. Pat. No. 5,182,606 granted on Jan. 26, 1993 discloses an image fusing apparatus including a heater; a film movable with a recording material, in which the recording material has a toner image thereon which is heated through the film by heat from the heater; and the film has a heat resistive resin base layer containing inorganic electrically initiative filler material and a parting layer containing electrically conductive filler material.

BRIEF SUMMARY OF THE INVENTION

The belt fusing system of the present invention and the method of heating it enables control of the fusing and stripping temperatures independently. The fusing temperature of a belt fusing segment is operated at a predetermined value which causes the toner images to become tacky while the temperature of the belt at the stripping roller is varied in order to vary the image gloss of the finished print.

The fuser belt is entrained about three rollers in such a manner that voltages applied to the three rollers allows different portions of the belt to be independently heated to desired operating temperatures.

One portion or segment of the belt cooperates with a pressure roll to form a fusing zone through which the fusing belt and substrates carrying toner images pass. The substrate passes through the fusing zone such that the toner images thereon contact the smooth-surfaced belt.

Another portion or segment of the belt constitutes a pre stripping area and cooperates with a stripping roller for effecting the desired stripping temperature.

Each distinctive portion or segment of the belt is heated such as to accomplish its intended purpose. The temperature of the fusing portion of the belt is normally heated to a single operating temperature while the stripping temperature is varied according to the degree of gloss desired.

DETAILED DESCRIPTION OF THE DRAWINGS

FIG. 1*a* is a schematic illustration of a fusing apparatus according to the invention.

FIG. 1*b* shows an enlarged fuser belt segment depicting the multilayered structure of the belt.

DESCRIPTION OF THE PREFERRED EMBODIMENT OF THE INVENTION

Figure 4:
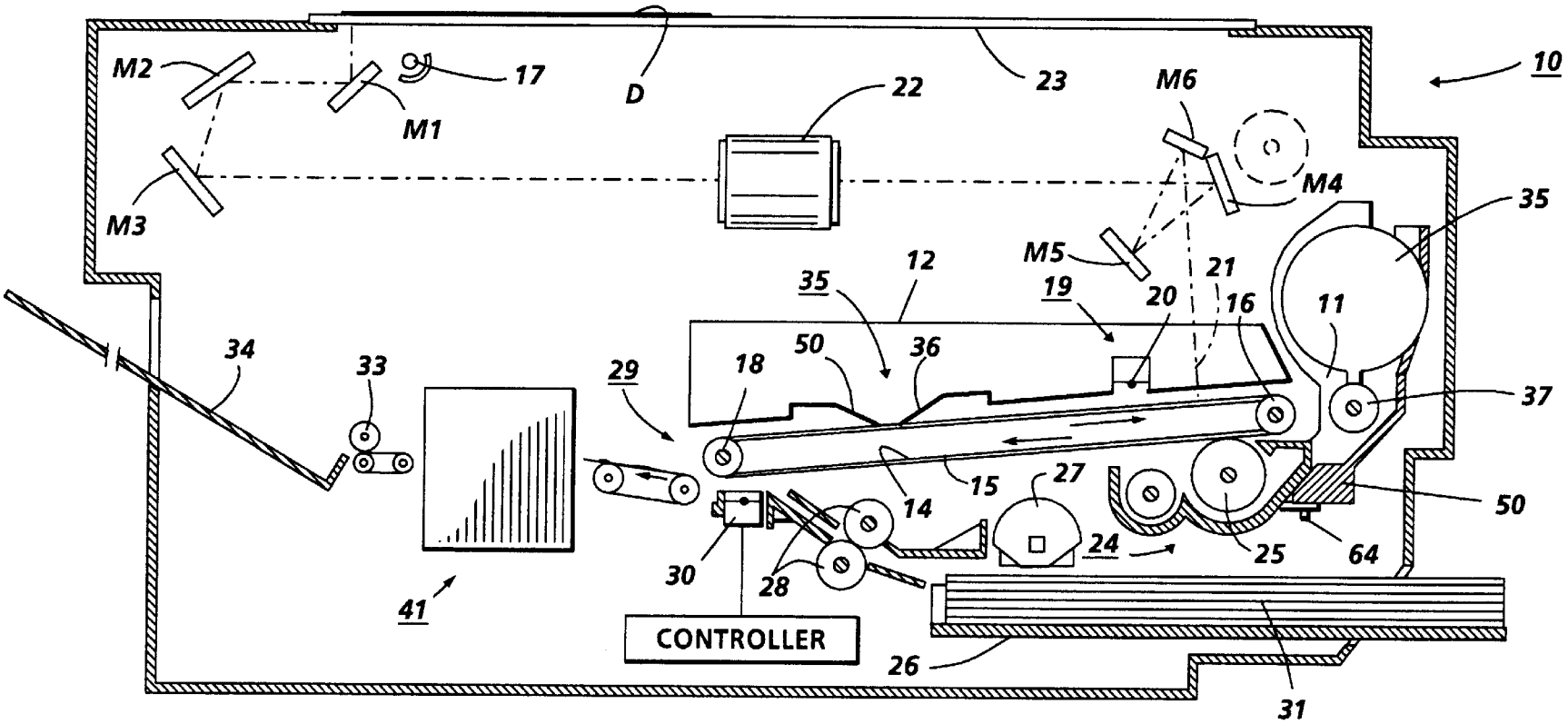
FIG. 4 is a schematic illustration of an imaging apparatus in which the fuser apparatus of FIG. 1 can be utilized.

Referring now to FIG. 4 there is shown by way of example, an automatic electrostatographic reproducing machine 10 which includes a removable processing cartridge 12. The reproducing machine depicted in FIG. 4 illustrates the various components utilized therein for producing copies from an original document. Although the invention is particularly well adapted for use in automatic electrostatographic reproducing machines, it should become evident from the following description that it is equally well suited for use in a wide variety of processing systems including other electrostatographic systems such as printers and is not necessarily limited in application to the particular embodiment shown herein.

The reproducing machine 10 illustrated in FIG. 4 employs a removable processing cartridge 12 which may be inserted and withdrawn from the main machine frame. Cartridge 12 includes an image recording belt-like member 14 the outer periphery of which is coated with a suitable photoconductive material 15. The belt or charge retentive member is suitably mounted for revolution within the cartridge about driven transport roll 16, around idler roll 18 and travels in the direction indicated by the arrows on the inner run of the belt to bring the image bearing surface thereon past a plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the uniformly charged portion of the belt 14 is moved to exposure station 21 wherein the charged photoconductive surface 15 is exposed to the light image of the original input scene information, whereby the charge is selectively dissipated in the light exposed regions to record the original input scene in the form of an electrostatic latent image.

The optical arrangement creating the latent image comprises a scanning optical system including lamp 17 and mirrors M1, M2, M3 mounted to a scanning carriage (not shown) to scan an original document D on an imaging platen 23. Lens 22 and mirrors M4, M5, M6 transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein toner is applied to the photoconductive surface 15 of the belt 14 rendering the latent image visible. The development station includes a magnetic brush development system including developer roll 25 utilizing a magnetizable developer mix having course magnetic carrier granules and toner colorant particles supplied from developer supply 11 and auger transport 37.

Sheets 31 of final support material are supported in a stack arranged on elevator stack support tray 26. With the stack at its elevated position, a segmented feed and sheet separator roll 27 feeds individual sheets therefrom to a registration pinch roll pair 28. The sheet is then forwarded to a transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt due to the beam strength of the support material 31 as it passes around the idler roll 18. The sheet containing the toner image thereon is advanced to fusing station 41 comprising a seamless, heated fuser belt structure 52, pressure roll 54 and a plurality of conductive roll structures 56, 58 and 60.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 at a cleaning station 35 which comprises a cleaning blade 36 in scraping contact with the outer periphery of the belt 14. The particles so removed are contained within cleaning housing (not shown) which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present invention to illustrate the general operation of an automatic xerographic copier 10 which can embody the apparatus in accordance with the present invention.

As disclosed in FIG. 16 the fusing apparatus according to thee present invention, comprises the seamless belt structure 52 having a resistive layer 64 a polyimide layer 66 and a release layer 65. Release layers are used to eliminate toner offset to the hot fusing belt. Common release layers include Viton, Teflon, silicones and other low surface energy materials.

The belt is entrained about the fuser rollers 56 and 58 as well as the stripping roller 60 and an idler roller 69. The rollers 56, 58 and stripping roller 60 are electrically conductive contact rollers which are electrically biased for applying voltages to a fusing belt segment 70 and the pre stripping area 72, the former of which is utilized for fusing toner images and the latter of which is utilized for effecting variable image gloss. By contact is meant, that the fusing rollers contact the resistive layer 64.

The pressure roller 54 cooperates with the rollers 56 and 58 and the belt fusing segment 70 disposed therebetween to form a fusing zone 73 through which substrates or sheets 31 carrying toner images 74 thereon are passed for fusing the toner images to the substrates. A total nip pressure of approximately 50 lbs. is exerted between the fuser roll 58 and the pressure roll 54 by conventional structure used for that purpose.

Figures 1A, 1B:
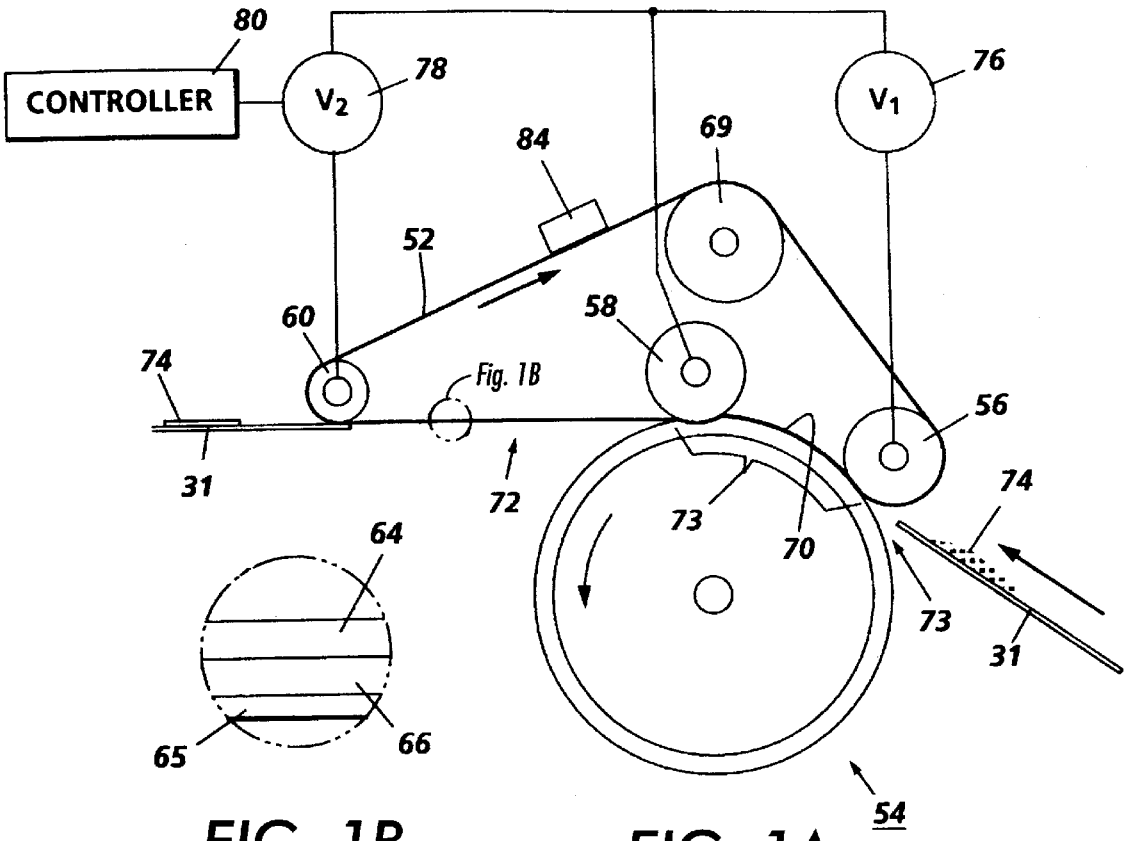
Figure 2:
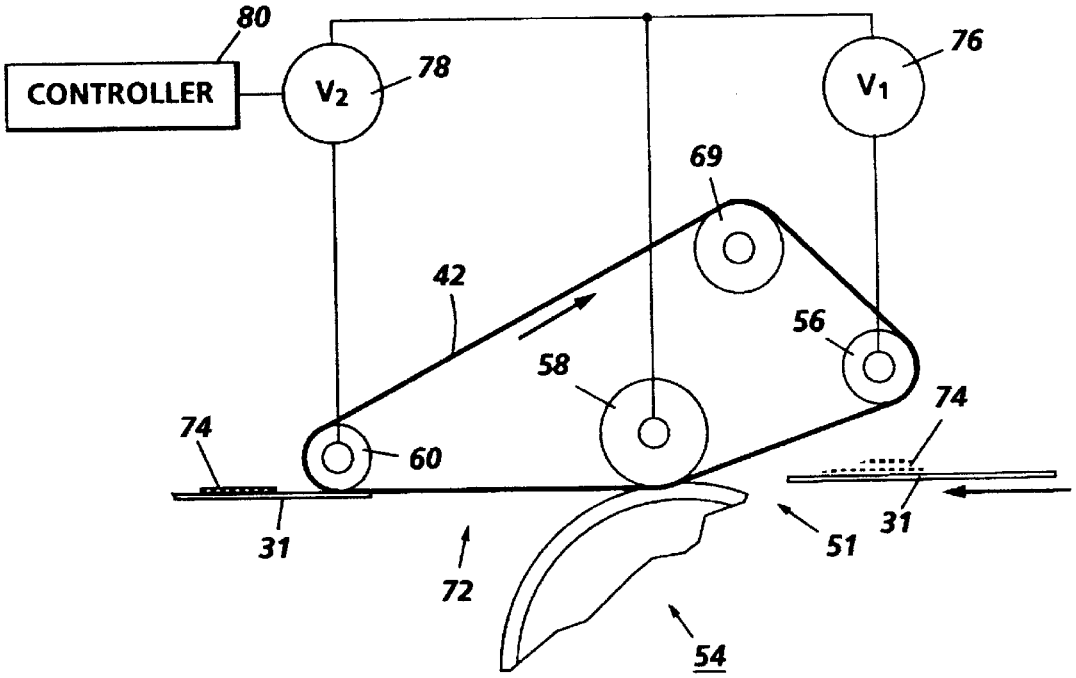
FIG. 2 is a schematic illustration of a modified embodiment of the invention illustrated in FIG. 1.

Alternatively, fusing roller 56 need not necessarily form a fusing zone with pressure roller 54 as shown in FIG. 2. As illustrated therein a fly-in zone 51 is provided by the positioning of the roller 56 as shown in FIG. 2. As will be noted, many of the components from FIG. 1 have been omitted since the they are not needed to illustrate the fly-in feature designated by reference character 51.

Electrical power for elevating the temperature of the fusing belt segment 70 is provided by AC power source 76 while power for elevating the belt segment 72 to control the stripping temperature is provided via power source 78 as illustrated in FIG. 1*a*. The power source 76 is applied between the fusing zone entrance fusing roller 56 and and exit fusing roller 58 as depicted in FIG. 1*a*. The power from source 78 is applied between exit fusing roller 58 and the striping roller 60. The use of a seamless belt construction is an important aspect of the invention in that a seamed belt is subject to arcing and wear at each make and break with the contact rollers. When a seamless belt construction is used there is no breaking of electrical contact to the belt thereby eliminating arcing and wear.

In operation, the magnitude of the power supplied via power source 76 to the fusing belt segment 70 is designed to operate at a single setpoint temperature to cause the toner forming the images to fuse to substrate 31. On the other hand, the power source 78 is designed to supply variable power to the pre stripping segment 72 under the control of the controller 80 such that the toner images are subjected to various stripping temperatures for the purpose of varying the image gloss of the final print.

Applying power to belt pre stripping segment 72 provides the ability to strip at selectable temperatures, thus enabling variable gloss. Images fused with zero volts and 80 volts showed a significant different in image gloss.

Images were fused using a 50 micron polyimide belt substrate 66 with a 12 micron PFA release layer 65 and a 15 micron inner resistive coating 64 with a resistivity of 85 ohm per square. Gloss as a function of input voltage to a two inch long pre stripping segment is depicted in FIG. 3.

Figure 3:
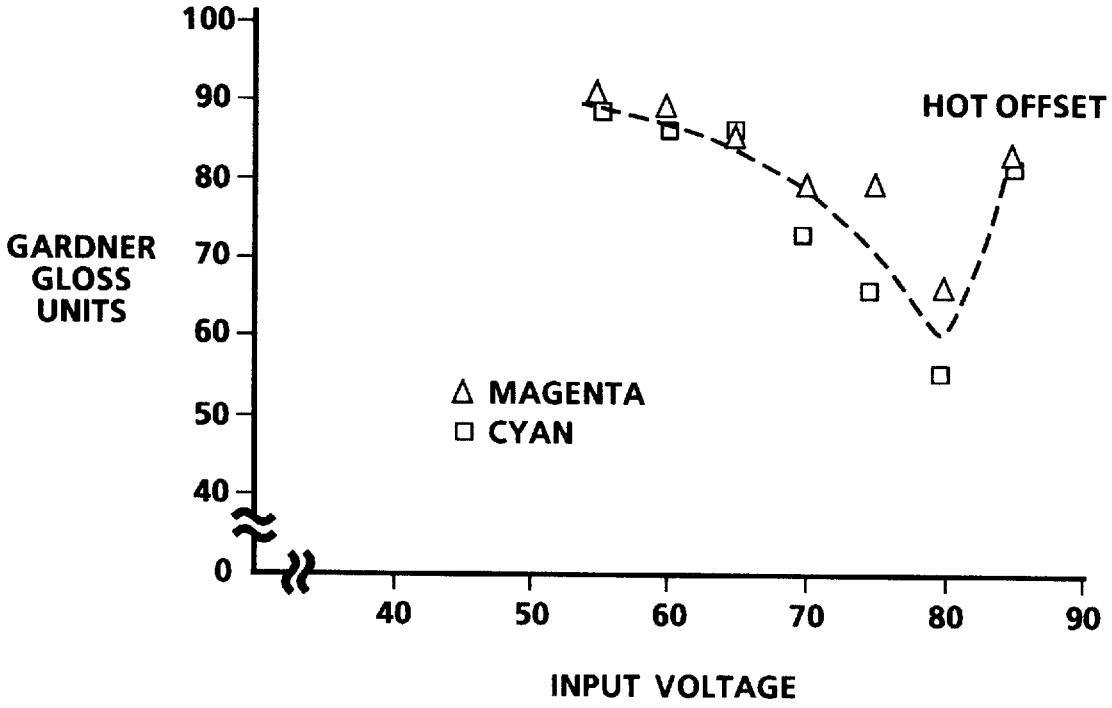
FIG. 3 is plot of image gloss versus voltage input to a pre stripping area of a fusing belt.

As can be seen in FIG. 3, image gloss varies with the input voltage. For example, input voltages in the order of 55 to 80 units, correspond to Gardner gloss units (the industry standard for gloss measurement) of 90 to 60.

A pad 84 containing a suitable release agent material such as silicone oil is supported in wiping contact with the surface 65 of the belt 52. Thus, the belt surface is thinly coated with silicone oil to prevent toner powder particles from adhering to it.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. A heat and pressure fuser for fusing toner images onto substrates, said fuser comprising:

an electrically resistive fusing belt having first and second segments;

means for elevating the temperature of said first and second belt segments to different temperatures, one for fusing toner images and the other for varying image gloss;

a plurality of rollers including first, second and third rollers for supporting said belt for movement in an endless path, said means for elevating the temperature of said first and second belt segments comprising means for electrically biasing said plurality of rollers; and a pressure roller cooperating with one of said plurality of rollers to form an extended fusing zone therebetween.

2. The apparatus according to claim 1 wherein said means for electrically biasing said rollers comprises means for applying an electrical bias to said first and second rollers for heating said first belt segment and to said second and third rollers for varying the images gloss of a final print.

3. A heat and pressure fuser for fusing toner images onto substrates, said fuser comprising:

an electrically resistive fusing belt having first and second segments;

means for applying a voltage to said first segment for elevating the temperature thereof and means for selectively applying one of a plurality of voltages to said second segment for elevating the temperature thereof for effecting images having different degrees of gloss;

a plurality of electrically conductive rollers for supporting said belt for movement in an endless path; and a pressure roller cooperating with one of said plurality of rollers to form an extended fusing zone therebetween.

4. A heat and pressure fuser according to claim 3 wherein said means for applying a voltage and selectively applying one of a plurality of voltages comprise means for applying voltages to said plurality of rollers.

5. A heat and pressure fuser according to claim 4 wherein said plurality of rollers comprise first, second and third rollers.

6. A heat and pressure fuser according to claim 5 wherein said means for applying voltages to said rollers comprises means for applying a voltage to said first and second rollers for heating said first belt segment and for applying voltages to said second and third rollers for providing different image gloss for a final print.

7. A method of fusing toner images onto substrates, said method including the steps of:

moving an electrically resistive fusing belt in contact with a pressure roll to form a nip through which substrates carrying toner images are passed with the toner images contacting said belt, said belt being supported for movement in an endless path by a plurality of rollers;

applying an electrical bias across a first segment of said belt for effecting fusing of said toner images;

selectively applying an electrical bias to a second segment of said belt for varying the degree of gloss imparted to said toner images.

8. The method according to claim 7 wherein said steps of applying and selectively applying an electrical bias are effected through said plurality of rollers supporting said belt for movement in and endless path.

9. The method according to claim 7 wherein said steps of applying and selectively applying are effected using first, second and third rollers.

10. The method according to claim 9 wherein said step of applying is effected through said first and second rollers and said step of selectively applying is effected through said second and third rollers.

* * * * *